US009208980B2

(12) United States Patent
Wallace et al.

(10) Patent No.: US 9,208,980 B2
(45) Date of Patent: Dec. 8, 2015

(54) PNEUMATIC DETECTOR WITH INTEGRATED ELECTRICAL CONTACT

(71) Applicant: KIDDE TECHNOLOGIES, INC., Wilson, NC (US)

(72) Inventors: Steven Wallace, Raleigh, NC (US); David Frasure, Wilson, NC (US)

(73) Assignee: Kidde Technologies, Inc., Wilson, NC (US)

( * ) Notice: Subject to any disclaimer, the term of this patent is extended or adjusted under 35 U.S.C. 154(b) by 136 days.

(21) Appl. No.: 14/159,752

(22) Filed: Jan. 21, 2014

(65) Prior Publication Data

US 2015/0206678 A1 Jul. 23, 2015

(51) Int. Cl.
*H01H 35/26* (2006.01)
*H01H 35/34* (2006.01)

(52) U.S. Cl.
CPC ..... *H01H 35/26* (2013.01); *H01H 35/34* (2013.01); *H01H 35/346* (2013.01)

(58) Field of Classification Search
CPC ..... H01H 35/26; H01H 35/34
USPC ..... 200/83 R
See application file for complete search history.

(56) References Cited

U.S. PATENT DOCUMENTS

| | | | | |
|---|---|---|---|---|
| 1,986,479 | A * | 1/1935 | Lowe et al. | 340/506 |
| 3,302,269 | A * | 2/1967 | Cooper et al. | 29/622 |
| 5,725,359 | A * | 3/1998 | Dongo et al. | 417/44.9 |
| 2005/0092586 | A1 * | 5/2005 | Lee | 200/83 R |
| 2013/0248346 | A1 | 9/2013 | Blakely | |

FOREIGN PATENT DOCUMENTS

| | | |
|---|---|---|
| EP | 1770737 | 4/2007 |

OTHER PUBLICATIONS

Extended European Search Report dated Jun. 17, 2015 in European Application No. 15151325.6.

* cited by examiner

*Primary Examiner* — Edwin A. Leon
*Assistant Examiner* — Iman Malakooti

(57) ABSTRACT

The present disclosure relates to an advanced pneumatic detector (APD) alarm switch. The present APD may comprise a deformable diaphragm configured to make contact with a contact surface. This contact surface may be integral to a surface of the insulating material within the APD.

13 Claims, 2 Drawing Sheets

PNEUMATIC DETECTOR WITH INTEGRATED ELECTRICAL CONTACT

FIELD

The present disclosure relates to alarms, fault pressure switches and their components, and more particularly, to a pneumatic detector with an integrated electrical contact.

BACKGROUND

Pneumatic pressure detectors used for an overheat and/or fire alarm system may use a gas which expands when heated and, as a result, actuates an associated deformable diaphragm to close an electrical switch indicating an alarm condition. Typically, these systems either use multiple deformable diaphragm switches, and/or multiple pressure inputs to operate the system.

SUMMARY

The present disclosure relates to an advanced pneumatic detector switch. The advanced pneumatic detector switch may comprise a gas-tight enclosure. The gas-tight enclosure may be coupled to an inlet for operable connection to a pressure side tube. The advanced pneumatic detector switch may comprise a deformable diaphragm coupled within the enclosure configured to make contact with an electrical contact surface in response to an increase in pressure within the gas tight enclosure communicated through pressure side tube. The electrical contact surface may be electrical contact surface coupled to an insulating material. The electrical contact surface may comprise a plated electrical contact surface. The electrical contact surface may pass through a gap coupling a gas-tight enclosure and a back pressure well. The electrical contact surface may be configured to create an electrical path from a deformable diaphragm to a contact side tube.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosure, it should be understood that other embodiments may be realized and that logical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step.

The present disclosure relates to the design of a pneumatic detector with an integrated electrical contact configured for use with alarms and fault pressure switches, such as a fire alarm system for an aircraft. Conventional systems use two separate switches and two separate diaphragms to indicate an alarm or fault condition. The pneumatic detection system is typically hermetic and contains a minimum normal pressure which is equivalent to the pressure where the surrounding environment is −65 F, and can set be as desired. This pressure is enough to deform a deformable diaphragm in the fault switch so it will create electrical continuity between the deformable diaphragm and a contact pin in response to an increase in pressure against the diaphragm. Thus, in response to the deformable diaphragm making contact with the contact pin an electrical circuit may be formed and an alarm may be triggered.

An advanced pneumatic detector ("APD") may be a diaphragm type, pneumatically-powered gate valve actuator designed to operate a "fail-closed" or "fail-open" safety valve. The APD may be configured for thermal detection. APDs may be utilized in wellhead safety valve applications, flow lines, header valves and gathering lines. APDs may be utilized in casing relief valve and storage valve applications. APDs are lightweight, and are generally easy to maintain.

Figure 1:
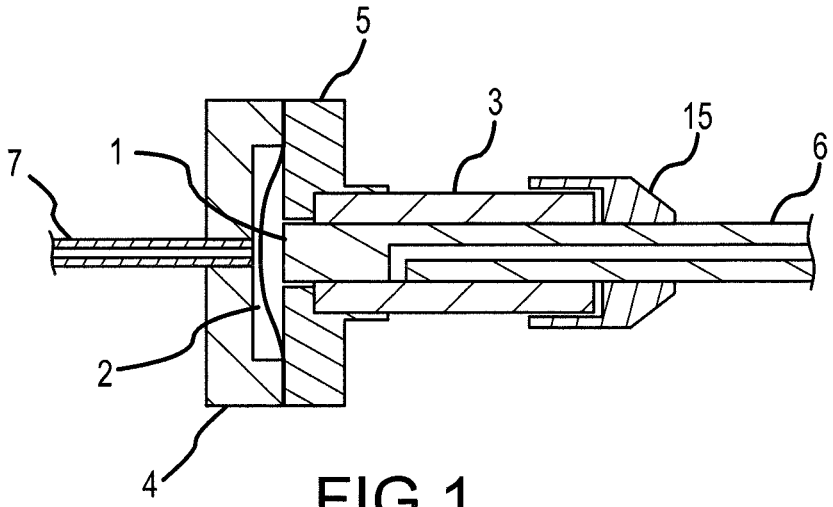
FIG.1 Prior Art
FIG. 1 depicts a traditional pneumatic detector switch in its default condition.
Figure 3:
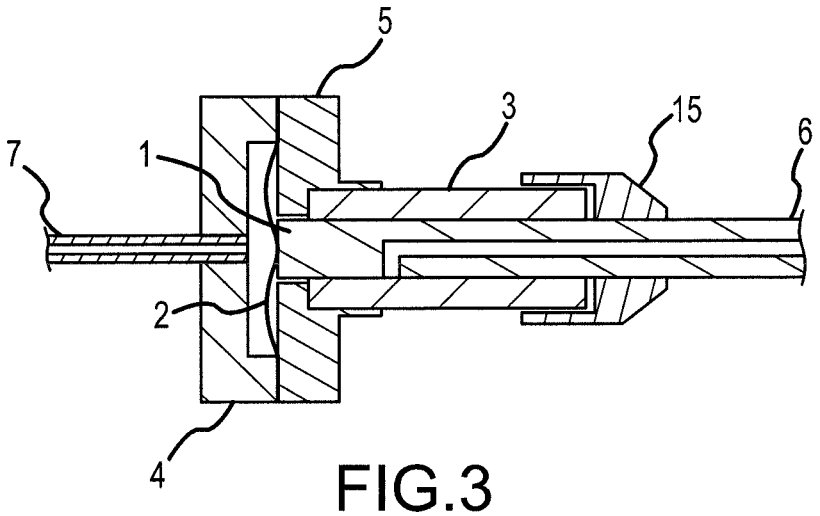
FIG.3 Prior Art
FIG. 3 depicts the traditional pneumatic detector switch of FIG. 1 with its deformable diaphragm in its deformed position.

FIG. 1 illustrates a typical advanced pneumatic detector alarm switch in a normal pressure condition (i.e., the electrical contact may be open in the default condition). A contact pin 1 is insulated via an insulating material 3 from the retainer section 5. A deformable diaphragm 2 and retainer sections 4 and 5 are electrically connected, so when the deformable diaphragm 2 engages the contact pin 1, as shown in FIG. 3, electrical continuity between the deformable diaphragm 2 and the contact pin 1 will occur, thus acting as an electrical switch. The switch shown in FIG. 1 consists of eight parts that are assembled in four stages. In this design, the contact pin 1 is positioned by the joint between the end cap 15 and the contact pin tube 6. After the switch is assembled, a vacuum is pulled through the contact pin tube 6 then the tube is hermetically sealed. FIG. 3 depicts the traditional pneumatic detector of FIG. 1 with its deformable diaphragm in its deformed position.

Figure 2:
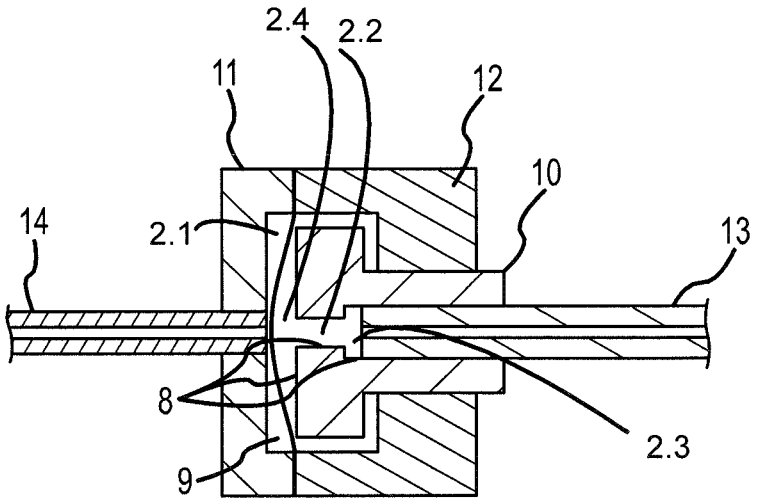
FIG. 2 depicts an advanced pneumatic detector switch in accordance with various embodiments.

FIG. 2 shows an advanced pneumatic detector according to various embodiments alarm switch at normal operating pressures (i.e., the electrical contact may be open in the default condition). The manner by which electricity is passed from the pressure side tube 14 to the contact pin tube 13 through the deformable diaphragm 9 is different than prior designs such as the design of FIG. 1. In the approach depicted in FIG. 2, the contact surfaces 8 are integral to at least one surface of the insulating material 10. Insulating material 10 may be a ceramic insulating material. Insulating material 10 may be configured to provide electrical isolation to retainer 12. A plated surface, such as contact surfaces 8, may be integral to and/or coupled to one or more surface of insulating material 10. Contact surfaces 8, may be in electrical communication with and create an electrical path to contact side tube 13 A gap formed in insulating material 10 at location 2.2 may couple a portion of well 2.3 to void 2.4. Void 2.4 may be a gas tight enclosure formed between deformable diaphragm 9 and retainer 12. Void 2.1 may be an enclosure formed between deformable diaphragm 9 and retainer 11. Void 2.1 may be in fluid communication with pressure side tube 14. The volume of well 2.3 may increase the thermal stability of the advanced pneumatic detector. For instance, in response to advanced pneumatic detector being subject to an increase in temperature, a back pressure is not created on deformable diaphragm 9 which may affect actuation pressure sufficient to deform deformable diaphragm 9 so as to make contact with contact surfaces 8.

Figure 4:
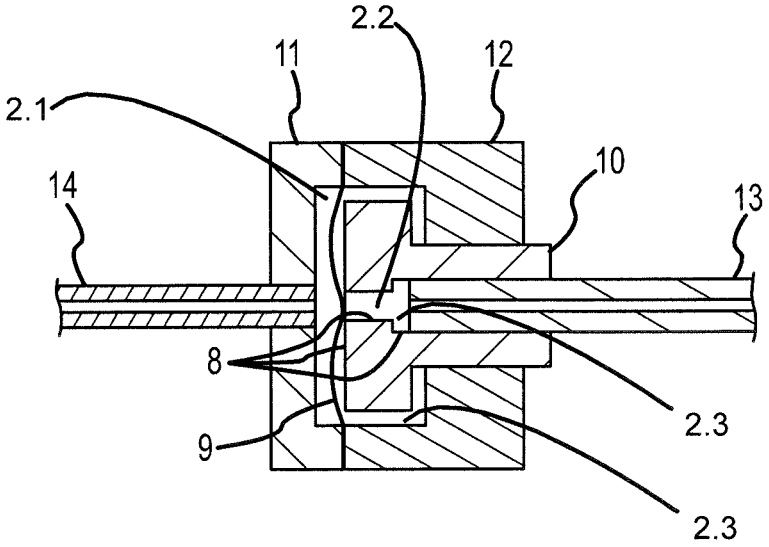
FIG. 4 depicts the advanced pneumatic detector switch of FIG. 2 with its deformable diaphragm in its deformed position; in accordance with various embodiments.

With continued reference to FIG. 2, the deformable diaphragm 9 may be made of any suitable material. For instance, the deformable diaphragm 9 may be made of a generally flat metallic discs stamped from a metal alloy sheet. The diameter of the discs may be appropriately sized to form a gas-tight seal between retainers 11 and 12. The advanced pneumatic detector alarm switch may comprise a pressure side tube 14 with a first end in fluid communication with void 2.1. Pressure side tube 14 may comprise a second end in communication with a pressure source (not shown). Contact side tube 13 may comprise a first end in fluid communication with void 2.4. Contact side tube 13 may comprise a second end coupled to a pressure draw, configured for creating a partial vacuum and/or hermetically sealing void 2.4. The pressure within void 2.4 may be scalable. The pressure level within void 2.4 may be set such that in response to a thermal increase and/or pressure increase sensed through pressure side tube 14 of a desired amount; deformable diaphragm 9 may deform and/or make contact with contact surfaces 8. Thus, the advanced pneumatic detector may operate as a switch that operates in response to a temperature increase. For instance, in response to pressure side tube 14 being exposed to high temperature, the pressure inside void 2.1 will rise. In response to the rise in pressure in void 2.1, deformable diaphragm 9 is deformed, responsive to a pre-determined background pressure, will further deform generally in a direction towards contact surface 8 and create a closed switch. An alarm may be triggered in response to the closing of the switch. FIG. 4 depicts the advanced pneumatic detector of FIG. 2 with its deformable diaphragm in its deformed position, in accordance with various embodiments.

The insulating material 10 may be configured to separate the retainers 11 and 12 from the contact side tube 13. The material of retainers 11 and 12 may be any suitable material, such as a molybdenum material. The insulating material 10 material may be any suitable material such as a ceramic material (e.g. alumina material). Prior to use in an APD, the contact side of the switch is evacuated the sealed. The switch is evacuated through the contact side tube 13.

According to various embodiments, and with reference to FIG. 4, the deformable diaphragm 9 is depicted as being in contact with an electrically conductive surface, which is shown as contact surface 8 in response to a pressure in void 2.4 being greater than normal. Voids 2.1 and 2.4 in combination may be defined as an internal area between retainers 11, 12. Deformable diaphragm may reside within void 2.1, 2.4. The contact surfaces 8 are integral to the insulation material 10. The contact surfaces 8 may take any shape; however, in various embodiments, the contact surfaces 8 are continuous from a contact point with the deformable diaphragm 9 to the contact side tube 13.

A few benefits of this approach are to simplify the manufacturing process and improve the robustness of the switch by decreasing the number of failure points. For instance, failures modes include loss of hermeticity and variation of the switching pressure due to changes in the contact pin position. By integrating the contact pin assembly and the ceramic isolator, variations in the switching pressure due to contact pin migration are reduced and/or eliminated.

According to various embodiments, the advanced pneumatic detector alarm switch may comprise a single deformable diaphragm 9 rather than two separate deformable diaphragms to indicate an alarm or fault condition. The advanced pneumatic detector alarm switch may comprise a single pressure input to sense an alarm or fault condition.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more."

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Different cross-hatching is used throughout the figures to denote different parts but not necessarily to denote the same or different materials.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An advanced pneumatic detector switch comprising:

a gas-tight enclosure comprising an inlet for operable connection to a pressure side tube;

a deformable diaphragm within the gas-tight enclosure configured to make contact with an electrical contact surface in response to an increase in pressure within the gas tight enclosure, the deformable diaphragm defining a pressure side void and a contact side void within the gas-tight enclosure, the pressure side void being in fluid communication with the inlet and the contact side void; and a contact side tube having a first end in fluid communication with the contact side void and a second end for being operatively coupled to a pressure draw for creating a desired negative pressure within the contact side void, wherein the electrical contact surface is disposed on an insulating material.

2. The advanced pneumatic detector switch according to claim 1, further comprising a back pressure well at least partially defined by the electrical contact surface.

3. The advanced pneumatic detector switch according to claim 1, further comprising a back pressure well disposed at least partially around an exterior circumference of the insulating material.

4. The advanced pneumatic detector switch according to claim 3, wherein the electrical contact surface passes through a gap in the insulating material, wherein the gap couples the gas tight enclosure and the well.

5. The advanced pneumatic detector switch according to claim 1, wherein the electrical contact surface is integral to the surface of the insulating material.

6. The advanced pneumatic detector switch according to claim 1, wherein the electrical contact surface is configured to create an electrical path from the deformable diaphragm to a contact side tube.

7. The advanced pneumatic detector switch according to claim 1, wherein the diaphragm is configured to deform in response to an increase in pressure in the pressure side void.

8. The advanced pneumatic detector switch according to claim 1, wherein the electrical contact surface comprises a plated electrical contact surface.

9. An electrical contact surface comprising:

a plated electrical contact surface disposed on an insulating material, wherein the electrical contact surface passes through a gap coupling a gas-tight enclosure and a back pressure well, wherein:

the gas-tight enclosure defines a pressure side void and a contact side void being separated by a deformable diaphragm, the contact side void is in fluid communication with a contact side tube configured to be operatively coupled to a pressure draw for creating a desired negative pressure within the contact side void, and the electrical contact surface is configured to create an electrical path from the deformable diaphragm to the contact side tube.

10. The electrical contact surface according to claim 9, wherein the back pressure well is configured to provide thermal stability.

11. The electrical contact surface according to claim 9, wherein the back pressure well is disposed at least partially around a circumference of the insulating material.

12. The electrical contact surface according to claim 9, wherein the electrical contact surface is integral to a surface of the insulating material.

13. The advanced pneumatic detector switch according to claim 1, wherein the deformable diaphragm is configured to deform in response to an increase in pressure in the pressure side void.

* * * * *